US005392549A

United States Patent [19]

Castro

[11] Patent Number: 5,392,549

[45] Date of Patent: * Feb. 28, 1995

[54] MAP DISPLAY AND STORAGE DEVICE

[76] Inventor: Jose L. Castro, 4165 Porte de Palmas-191, San Diego, Calif. 92122

[ * ] Notice: The portion of the term of this patent subsequent to Dec. 8, 2009 has been disclaimed.

[21] Appl. No.: 165,171

[22] Filed: Dec. 13, 1993

Related U.S. Application Data

[60] Division of Ser. No. 987,180, Dec. 8, 1992, which is a continuation of Ser. No. 708,131, May 30, 1991, Pat. No. 5,168,647.

[51] Int. Cl.[6] ..... G09F 11/18

[52] U.S. Cl. ..... 40/518; 40/593; 40/597; 40/904; 160/85; 160/241; 160/370.22; 296/97.6; 296/97.7; 296/97.8

[58] Field of Search ..... 40/117, 471, 518, 520, 40/593, 597, 904; 296/97.4, 97.6, 97.7, 97.8; 160/85, 86, 120, 122, 241, 370.2 A

[56] References Cited

U.S. PATENT DOCUMENTS

| | | | |
|---|---|---|---|
| 687,870 | 12/1901 | Watkinson | 160/85 |
| 1,614,957 | 1/1927 | Holloway et al. | 40/515 |
| 1,896,935 | 2/1933 | Bloomfield | 40/518 |
| 3,128,688 | 4/1964 | Coda | 160/85 X |
| 3,980,122 | 9/1976 | Takazawa | 160/85 |
| 5,024,479 | 6/1991 | Bryngelson | 296/97.7 |
| 5,168,647 | 12/1992 | Castro | 160/85 X |

FOREIGN PATENT DOCUMENTS

| | | | |
|---|---|---|---|
| 1268866 | 9/1960 | France | 160/85 |
| 14957 | 7/1902 | United Kingdom | 160/85 |

*Primary Examiner*—Brian K. Green

*Attorney, Agent, or Firm*—Henri J. A. Charmasson; John D. Buchaca

[57] ABSTRACT

A device in combination with a driving station of a vehicle for displaying and storing a flexible web containing information wound in two cylinder members that provide sufficient slag in the web to form a loop that holds a weighting member. The weighting member is pulled away from the first two cylinders either by gravity or spring action and the web is exposed by turning at least one of the two cylinder members. The two cylinder members an be manually or electrically actuated. A user thereby views a specific area of the map or information contained in the web. An electric bulb is provided to illuminate the web from inside the loop.

10 Claims, 5 Drawing Sheets

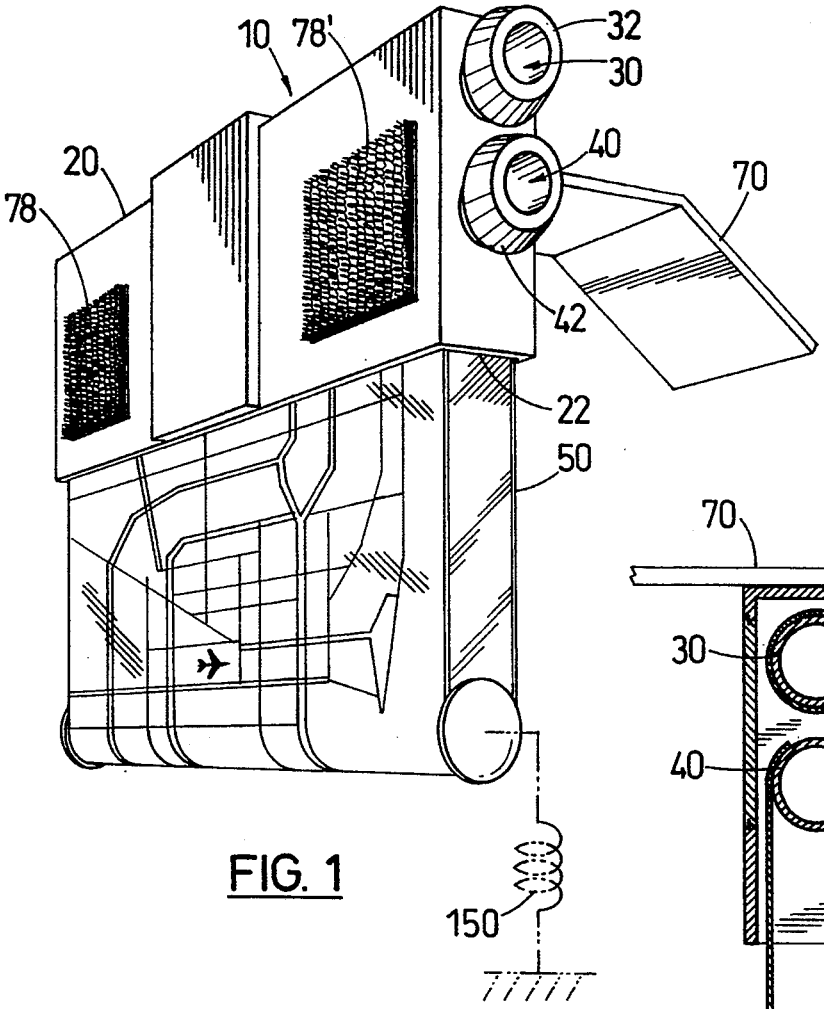
FIG. 1
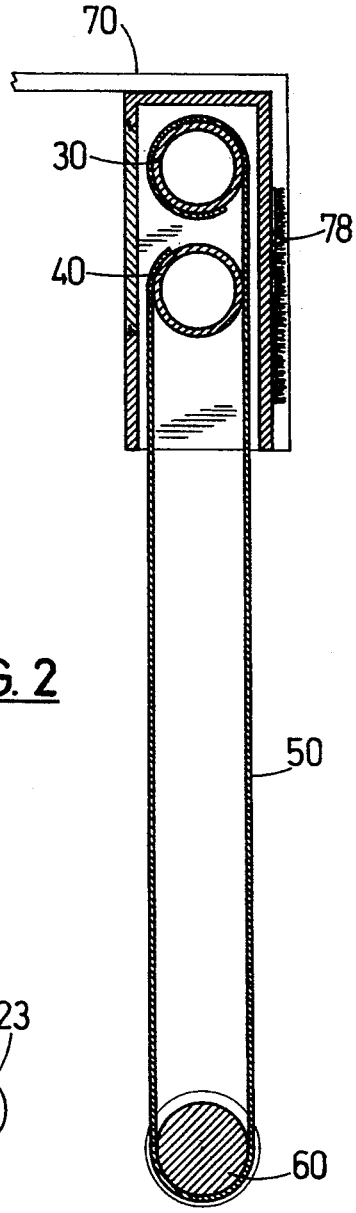
FIG. 2
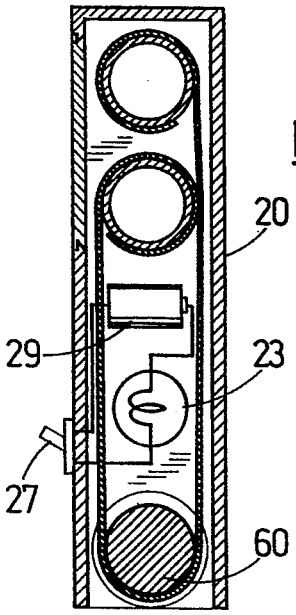
FIG. 2A
FIG. 2B
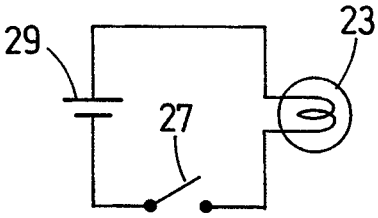

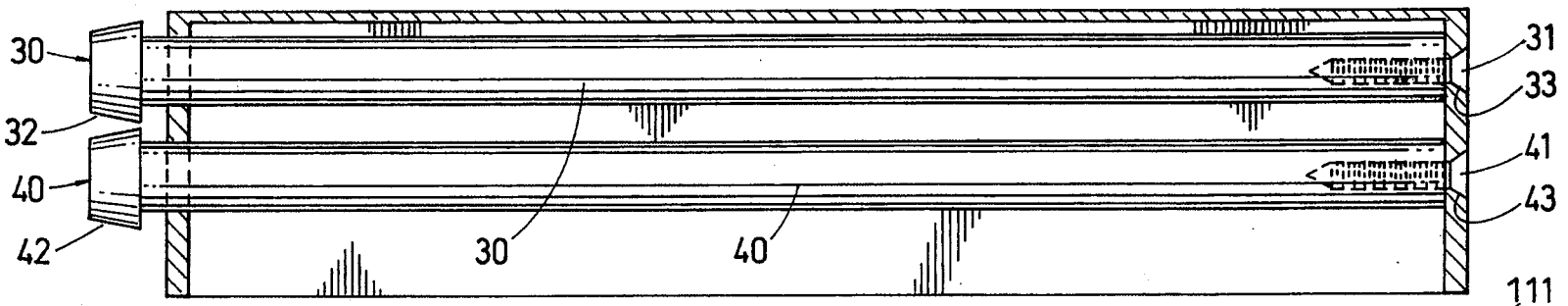
FIG. 3
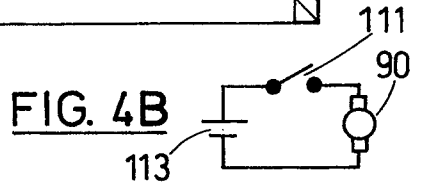
FIG. 4B
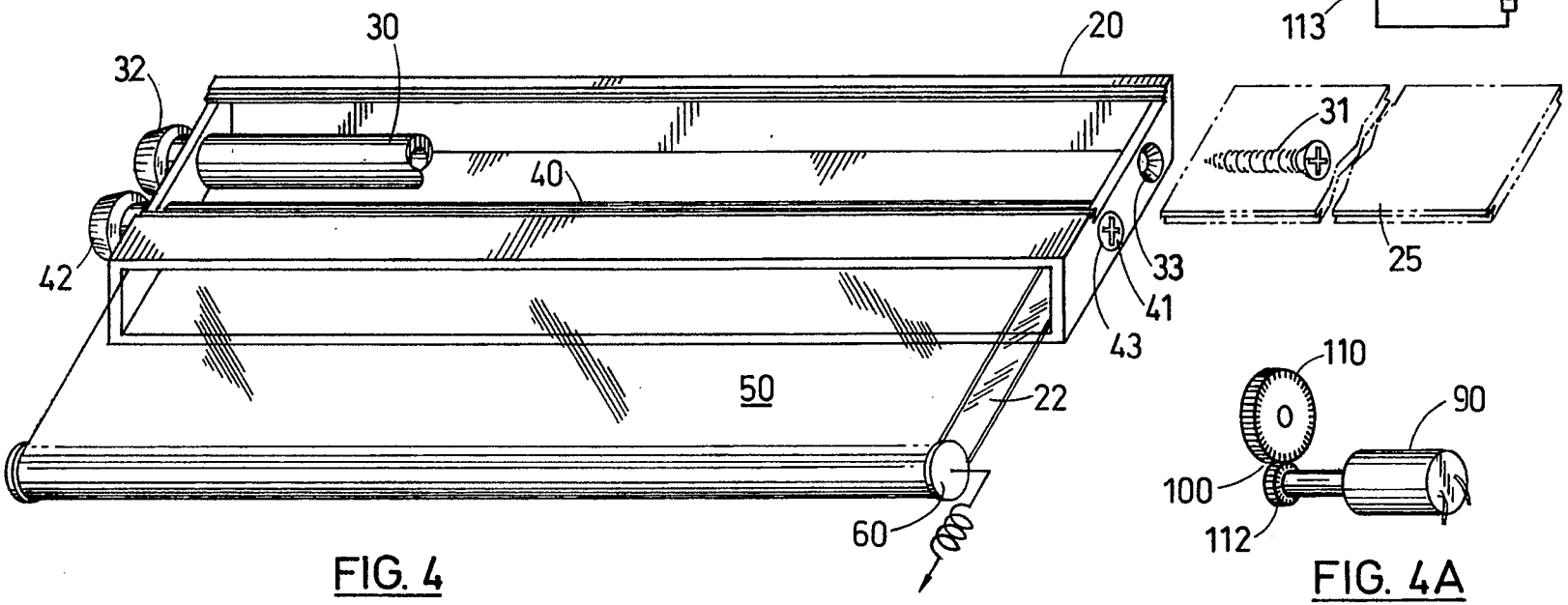
FIG. 4
FIG. 4A

MAP DISPLAY AND STORAGE DEVICE

PRIOR APPLICATION

This is a divisional continuation application of copending application Ser. No. 07/987,180, filed Dec. 8, 1992, now abandoned, which is a continuation of Ser. No. 07/708,131 filed May 30, 1991, now U.S. Pat. No. 5,168,647.

FIELD OF THE INVENTION

This invention relates to devices for holding and storing maps and other information that can be affixed or printed to a flexible web made out of paper, plastic, cloth or the like.

BACKGROUND OF THE INVENTION

When the user unfolds a map, he or she generally struggles to locate the area of interest after displaying a considerably large unmanageable portion of map. Not infrequently this is done while sitting inside a vehicle with limited light and space, frequently while moving. This causes considerable obstruction of the sight and also increases the probability of damaging the map being examined. All this also causes the user to waste time.

SUMMARY OF THE INVENTION

It is one of the main objects of the present invention to provide a device for displaying and storing maps and other information that can be affixed or printed to a web of a flexible material capable of being rolled. Such a device may be installed in the driving station of a vehicle, preferably in front of the person controlling such a vehicle. For instance, the device can be attached to the rear view mirror, sun visor or windshield of an automobile.

It is another object of this present invention to provide a volumetrically efficient apparatus for storing and displaying a map or other information printed to a flexible web.

It is another object of this invention to provide such a device that is electrically illuminated.

It is yet another object of this present invention to provide such a device that is inexpensive to manufacture and maintain while retaining its effectiveness.

It is also another object of this invention to provide such a device that the case or housing storing the map of one city should be easily interchanged with other cases containing maps of other different cities, in a similar way as changing, for instance, a cassette on a cassette recorder.

It is yet another object of the present invention to provide such a device that the housing storing the desired information could be manually slid to the right side or to the left side, within a magnet holder, for the convenience of the user.

BRIEF DESCRIPTION OF THE DRAWING

FIG. 1 is a perspective view of an embodiment for the present invention showing a portion of the web containing the information sought to be displayed protruding downwardly;

FIG. 2 shows an end view of the apparatus shown in FIG. 1 wherein the end wall of the housing has been removed so that the internal components of the device can be seen;

FIG. 2*a* shows a similar view to the one shown in FIG. 2 wherein a light bulb circuit has been included;

FIG. 2*b* represents the electrical schematic of the light bulb circuit including a battery and a switch, as shown in FIG. 2*a;*

FIG. 3 illustrates a back view of the device represented in the previous figures wherein the back wall of the housing has been removed in order to expose the internal components;

FIG. 4 is a representation of an isometric view of the device shown in the previous figures wherein the housing is partially broken and the internal components are shown;

FIG. 4*a* illustrates an alternate method of driving the cylinder through the electric motor to expose the web information that it contains;

FIG. 4*b* represents the electronic circuit that drives the electric motor;

FIG. 4–17 illustrates four alternate embodiments of limitless possible combinations wherein a plurality of rollers, maps and weighting members combinations can be constructed, as shown in said figures.

DESCRIPTION OF THE PREFERRED EMBODIMENT OF THE INVENTION

Figure 5:
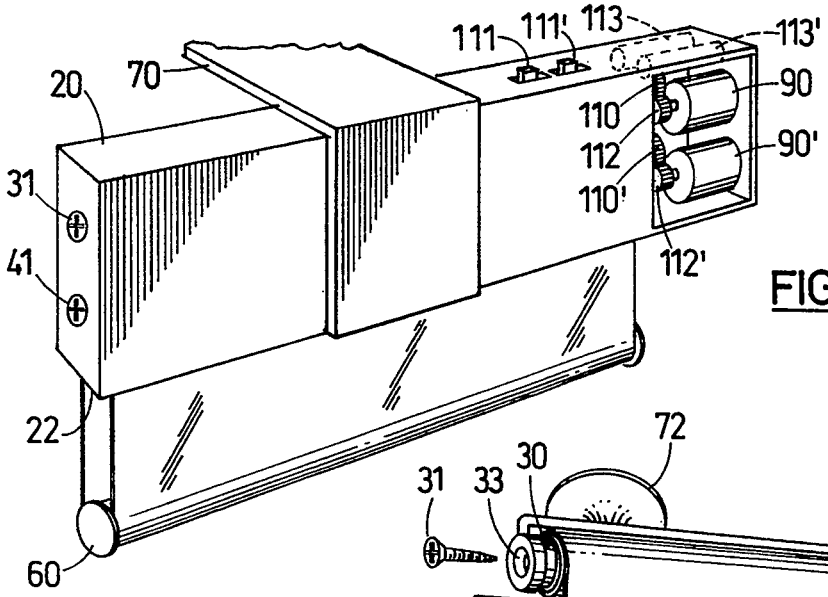
FIG. 5 is an alternate embodiment that includes two electrically driven motors for actuating the cylinders.

Referring now to the drawings, where the present invention is generally referred to with the numeral 10, it can be observed that it basically includes a housing 20 wherein two internally disposed scrolling cylinder members 30 and 40 contain flexible web 50 that in turn contains the information to be displayed, such as a map or instructions, etc. Web 50 is pulled down by the weight of outer cylinder 60 acting on a loop created by web 50 in the preferred embodiments. Also, it is possible to spring bias outer cylinder member 60 with spring member 150 so that reliance on the gravitational force is not necessary. Hanger or brace member 70 is preferably removably mounted to housing 20 and is capable of being mounted to any fixed place within the driving station of a vehicle for the convenience of the user. The mechanism for mounting device 10 can be implemented in many different ways including screws, glue, hook and vane fasteners, magnets, adhesive tapes, resilient clips, etc. In the embodiment shown in FIG. 4, cover 25 is removably mounted to housing 20, to permit access to cylinder members 30 and 40.

In operation, a user turns either cylinder member 30 or 40 to put out or take in web 50. Both can be simultaneously operated to displace the map. In this manner, frequent consultations or look up operations for a specific area of interest do not require the entanglement of unwinding the entire web 50. Nevertheless, a user may unwind the entire map, if necessary, and the space permits.

In FIGS. 3 and 4, flathead screws 31 and 41 are rigidly mounted to the ends of cylinders 30 and 40 that do not have the knobs. Screws 31 and 41 cooperatively fit in counter-sunk openings 33 and 43 and rotate therein.

In FIG. *2a*, an alternate embodiment showing an electric light bulb circuit is represented including light bulb battery 25 and switch 27. Light bulb 23 is positioned inside web 50 so that the latter is illuminated from the inside out. This is specially effective when web 50 is made out of a translucent material.

Figure 6:
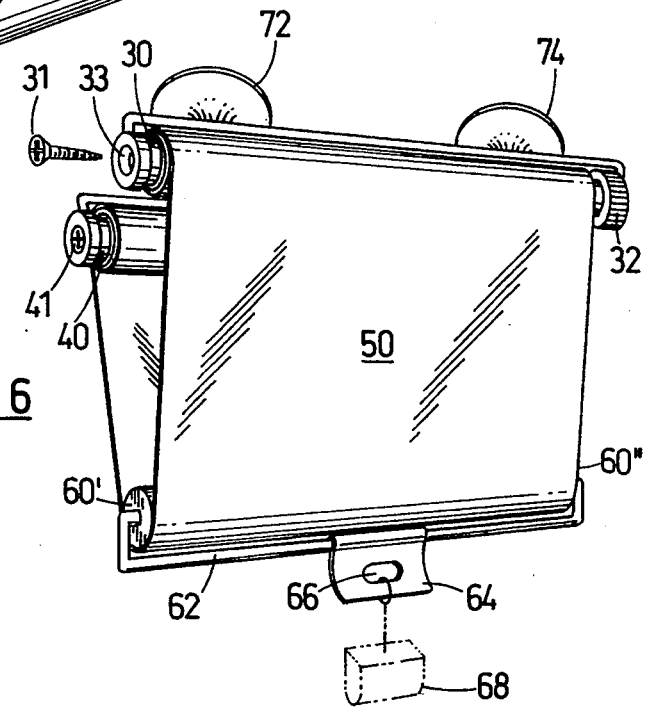
FIG. 6 illustrates a second alternate embodiment that utilizes a simple structure, instead of a housing and two roller members engaged in the loop of the web instead of one single cylinder.

Another manner of implementing a mounting mechanism is shown through the use of hook and vane fasteners 78 affixed to the outer walls of housing 20 and 77 affixed to the back of a rear view mirror or to any structure within the driving station of a vehicle. Also, brace member 70 can be supported by suction cups 72 and 74 as shown in FIG. 6.

Preferably internal cylinder members 30 and 40 are manually driven through knobs 32 and 42. But, it is also possible to drive them through electrical motor 90 including, for instance, pinion gear assembly 100 properly meshed with a teethed knob 110 as shown in FIG. 4a. This electrical application will permit the faster and more accurate access of the required information since these motors can be servo mechanism or step motors that are computer driven for a specific number of turns that correspond to a given location of the information in the web.

Housing 20 is shown in FIG. 1 showing an opening 22 through which web 50 falls outwardly by gravity or by a spring member 150. Spring member 150 can be mounted to a fixed position to exert a suitable force on outer cylinder member 60. Preferably cylinder member 60 is held in a loop formed by web 50 that slides on the surface of cylinder member 60 and/or cylinder member 60 is rotatably mounted thereby permitting the easy exposure of Web 50.

As shown in FIG. 5, cylinder members 30 and 40 can be driven through the electric motors 90 and 90' which are meshed with toothed knobs 110 and 110' through pinion gears 112 and 112'. Again, the rotation of motors 90 and 90' can be controlled through the use of switches 111 and 111'.

Figure 10:
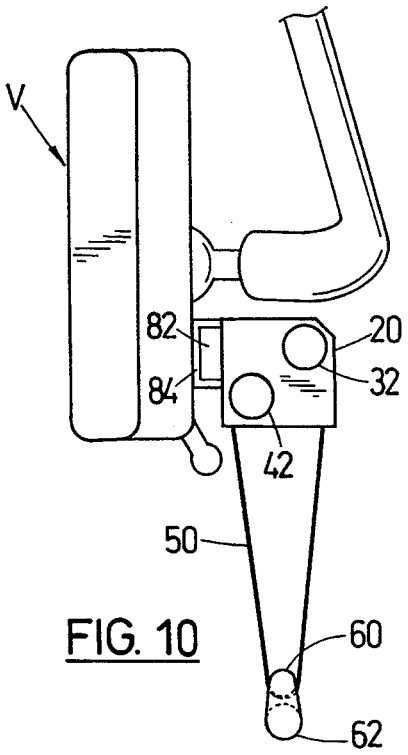
FIG. 10 is an end view of the device represented in FIG. 9, attached to a typical rear view mirror of Mercedez Benz, BMW and Porsche brands, showing a volumetrically efficient design of the apparatus.
Figure 11:
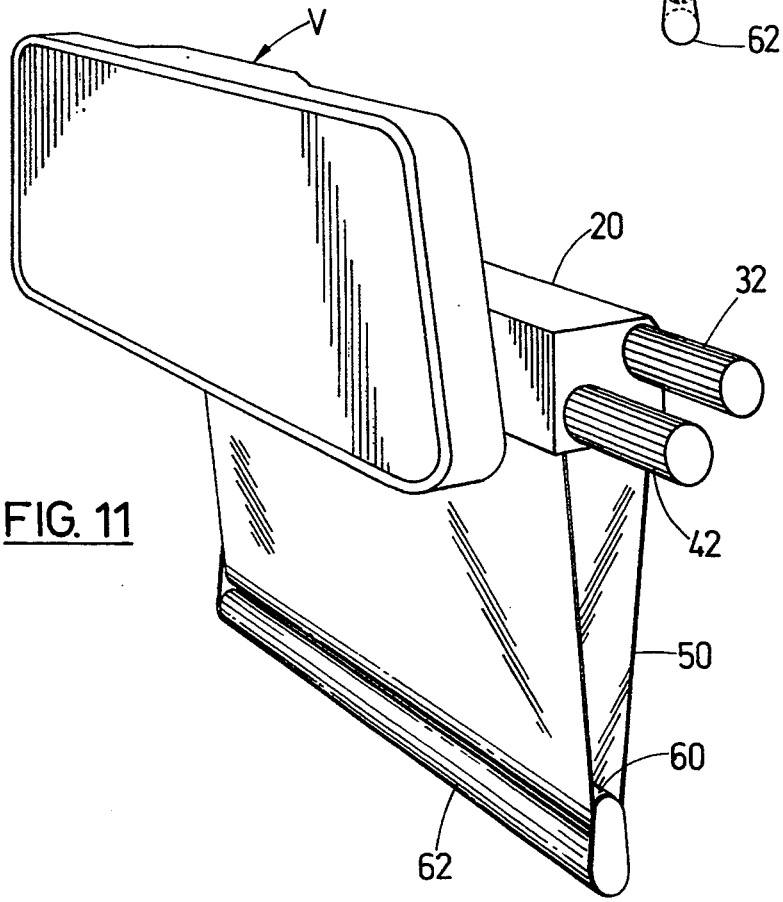
FIG. 11 is perspective view of the device shown in FIGS. 9 and 10, attached to a rear view mirror.

In FIG. 6, another alternate embodiment is shown without requiring the use of a housing 20. In this apparatus, the first cylinder 30 and second cylinder 40 are rotatably mounted to the structure 21. Also, in FIG. 6 can be seen that outer weighting members 60 may be combined with a pull-tab 64 attached to a swing bar 62 having bent extremities rotatively and concentrically engaged into opposite ends of cylinder 60. An additional weight 68 can be suspended through an aperture 66 in the pull-tab 64. Also, FIGS. 6, 10 and 11 show that the scrolling cylinder members 30 and 40 can be horizontally spaced apart in order to stabilize the dangling web 50 and weighting cylinder 60. The horizontal spacing between the scrolling rollers 30 and 40 should be sufficient, in relationship to the diameter of the weighting cylinder 60 to place the dangling front and back sections of the web in converging oblique planes for better stability. It should also be noted that the stability of the displayed part of the web is improved by having the web 50 wound-out or taken-up from opposite sides of the scrolling rollers assembly.

Figure 7:
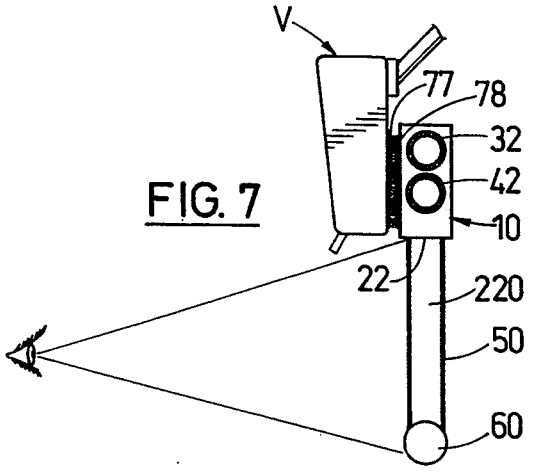
FIG. 7 shows one possible installation of the device represented in FIG. 1.
Figure 8:
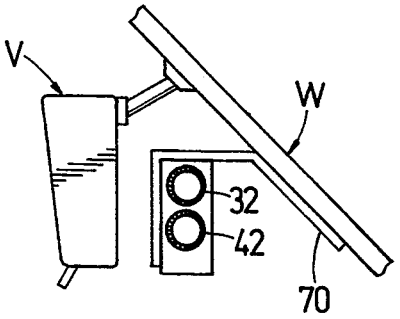
FIG. 8 illustrates another possible installation for the device shown in FIG. 1.

FIGS. 7 and 8 show two different areas in a vehicle where the present invention can be mounted. In FIG. 7, cooperating hook and vane fasteners 77 and 78 are used as removable means for attaching device 10 to the back surface of a rear view mirror V. In FIG. 8, holder 70 is shown preferably glued against the inner surface of windshield W, but it can also be fixed with suction cup members, adhesive tapes, hook and vane fasteners, magnetic means, etc.

Figure 9:
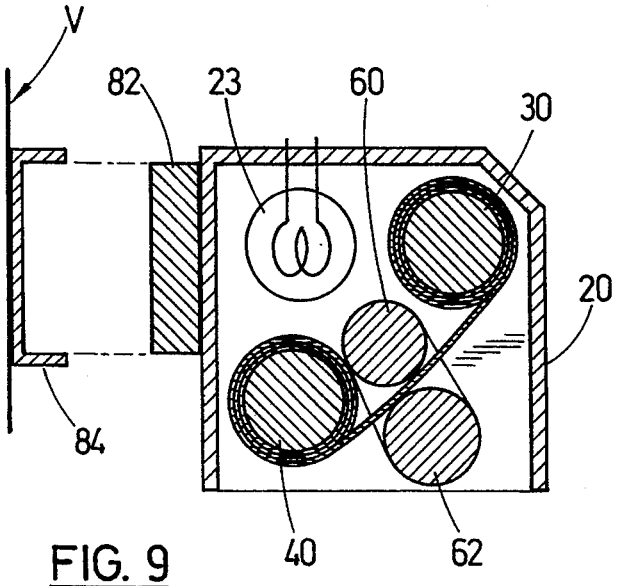
FIG. 9 is an enlarged transverse sectional view of a third alternate embodiment showing the internal components of the apparatus.

In the alternate embodiment 10 shown in FIGS. 9, 10 and 11, the case 20 is mounted to a rear view mirror V through magnet member 82 which is bonded to the housing 10. The magnet member 82 cooperatively fits in the counter sunk receptive holder 84, which is bonded to the back of rear view mirror. In this manner, the case 20 storing the map 50 mounted to the rear view mirror V can be easily slid to the left or to the right hand side of the rear view mirror V if the user desires to rectify the ubication of the device, and the housing 20 containing the desired information can be readily mounted and/or removed as desired to.

Figure 12:
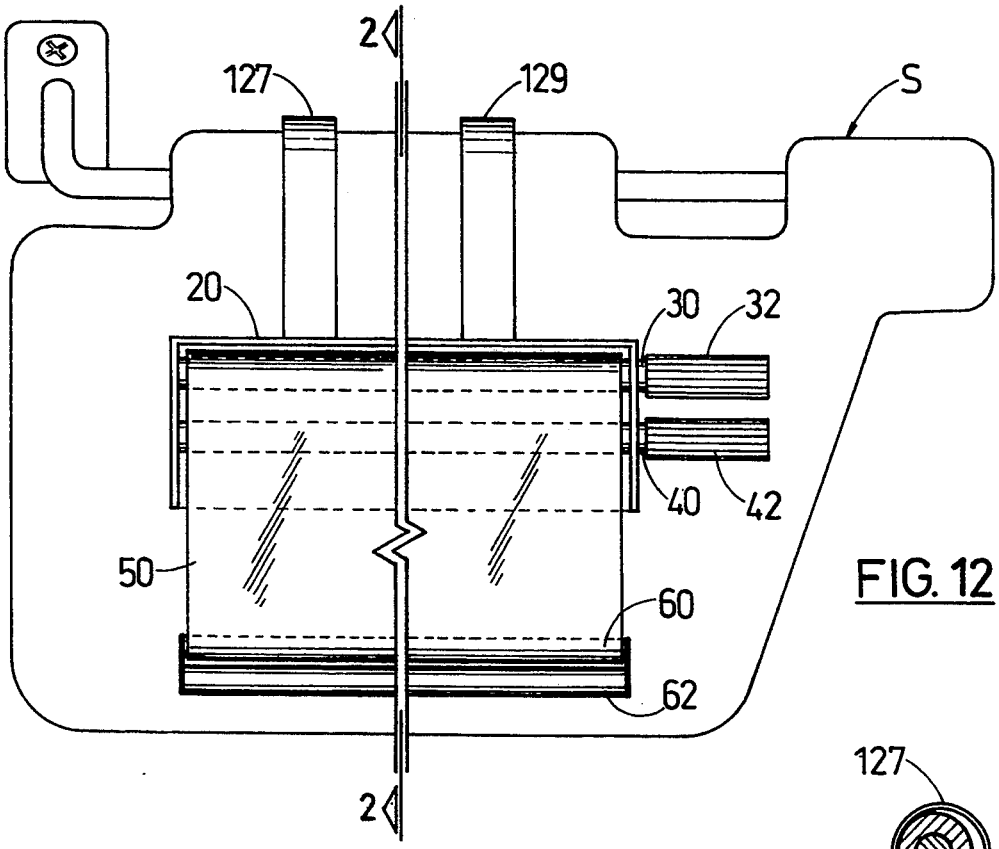
FIG. 12 is a face elevational view of a fourth alternate embodiment which has no front wall, secured to a conventional automobile sun visor.
Figure 14:
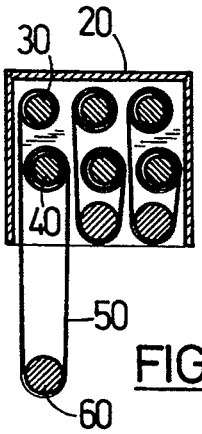
Figure 15:
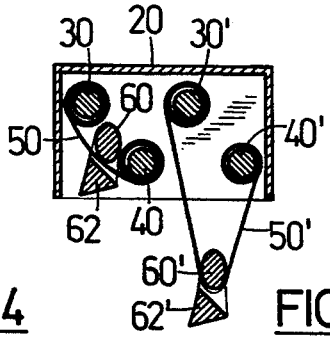
Figure 13:
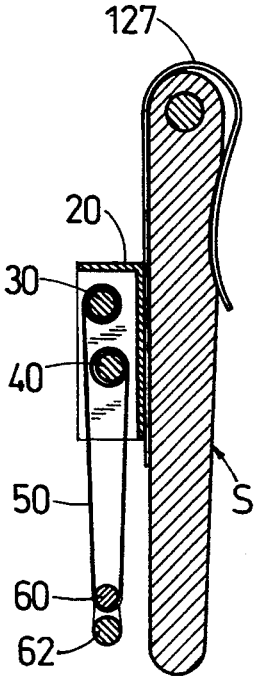
FIG. 13 shows a transverse sectional view taken on the line 2—2 of FIG. 12.
Figure 16:
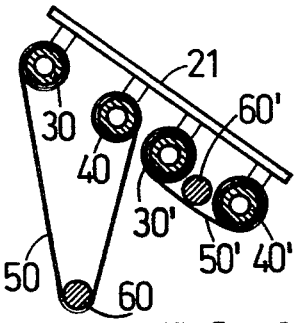
Figure 17:
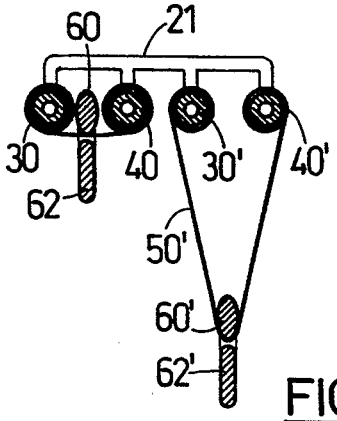

FIGS. 12 and 13 illustrate an alternate apparatus 10 in which the housing 20 has no front wall, so the map could be conveniently observed and displayed manually through knobs 32 and 42. The housing 20 is secured to a sun visor S with two spaced resilient clips 127 and 129.

As it can be seen in FIGS. 14, 15, 16, and 17, a plurality of map display combinations can be installed within a single housing 20.

It is understood also that the present invention can be practiced including either a housing 20 or a simple structure 21 as shown in FIG. 6 and the components of the invention can have different shapes and dimensions to accommodate different maps or webs containing information.

While the preferred embodiments of the invention have been described, modifications can be made and other embodiments may be devised without departing from the spirit of the invention and the scope of the appended claims.

What is claimed is:

1. A combination of a vehicle comprising a structure within hand-reach of a person sitting in said vehicle and a document display apparatus attached to the structure, said document display apparatus including:

a web adapted to carry information applied thereon, said web having first and second ends;

first cylinder means, having a first rotation axis, and holding said web wound thereon from said first end;

second cylinder means, having a second rotation axis, and holding said web wound thereon from said second end;

third cylinder means, having a third rotation axis, suspended by said web and so arranged and constructed that said web forms a loop that cooperatively receives said third cylinder means and said third cylinder means urges said loop downwardly when at least one of said first and second cylinder means is unwound, said first, second and third axes being parallel to one another, and said first and second axes being sufficiently horizontally spaced apart to cause said loop to form two planar sections laying in converging oblique planes.

2. The combination of claim 1, wherein said web is wound on said first and second cylinder means from opposite sides of said cylinder means.

3. The combination of claim 1, wherein said first and second cylinder means include means for turning said first and second cylinder means.

4. The combination of claim 3, wherein said apparatus further comprises a housing covering said first and second cylinder means, said first and second cylinder means are rotatably supported on said housing and wherein said housing includes an opening for allowing said third cylinder means to pass through said opening.

5. The combination of claim 4, wherein said means for turning said first and second cylinder means includes a knob member that protrudes outwardly from said housing.

6. The combination of claim 1 further including means for holding said apparatus to said structure.

7. The combination of claim 6, wherein said means for holding said apparatus includes suction cup members.

8. The combination of claim 6 wherein said means for holding said apparatus include a magnetic means.

9. The combination of claim 1, wherein said apparatus further comprises means for illuminating said web positioned inside said loop, said means for illuminating said web includes a light bulb member and battery means connected thereto and further including switch means for interrupting the connection of said battery means to said light bulb member.

10. The combination of claim 9, wherein said web is made out of a translucent material.

* * * * *